United States Patent [19]

Lee et al.

[11] 4,400,141

[45] Aug. 23, 1983

[54] HYDRAULIC PUMP UNIT

[76] Inventors: Jack E. Lee, Rte. 3, Box 187; Troy G. Barrett, Rte. 3, Box 243B, both of Carthage, Tex. 75633

[21] Appl. No.: 276,261

[22] Filed: Jun. 23, 1981

[51] Int. Cl.[3] ..... F04B 47/04

[52] U.S. Cl. ..... 417/360; 60/372

[58] Field of Search ..... 60/371, 372, 369; 166/75 A, 79; 175/219; 417/360

[56] References Cited

U.S. PATENT DOCUMENTS

| | | | |
|---|---|---|---|
| 1,619,474 | 3/1927 | Hubbard | 60/372 |
| 2,564,285 | 8/1951 | Smith | 60/372 |
| 2,572,748 | 10/1951 | Noll et al. | 60/372 |
| 2,874,641 | 2/1959 | McCandlish et al. | 60/372 X |
| 2,887,846 | 5/1959 | Habemeht | 60/372 |
| 4,191,016 | 3/1980 | Roth et al. | 60/372 |

*Primary Examiner*—Leonard E. Smith

[57] ABSTRACT

A hydraulic pump unit for pumping oil from oil-bearing strata which includes a frame slidably mounted on a stationary push-off tray and a hydraulic pumping unit mounted on the frame, which pumping unit further includes a pair of hydraulic cylinders supporting a head assembly. The head assembly is carried by a traveling mast slidably positioned in a vertically-oriented, stationary mast mounted on the frame, and includes a pair of rotatably-mounted chain rollers carrying a pair of chains attached to the stationary mast at one end and a bridle at the opposite end, which bridle also carries a polish rod extending into the well. Extension of the pistons in the hydraulic cylinders according to a selected hydraulic fluid flow control system causes the head assembly and traveling mast to move upwardly and the rollers to rotate with respect to the head assembly and extend the chains and polish rod upwardly to effect pumping of oil from the well. The hydraulic pump unit frame can be slidably displaced on the push-off tray by means of a third hydraulic cylinder to move the unit away from the well head in order to perform maintenance on the well.

18 Claims, 20 Drawing Figures

FIG. 14
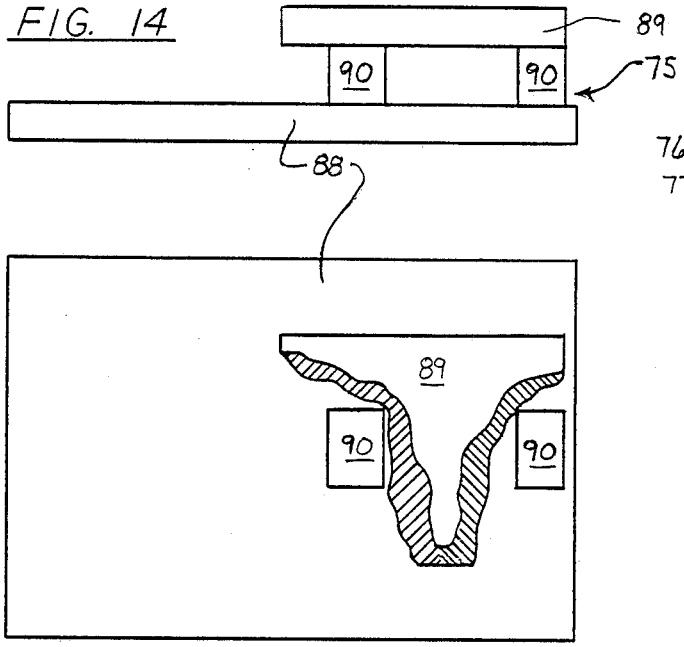
FIG. 16
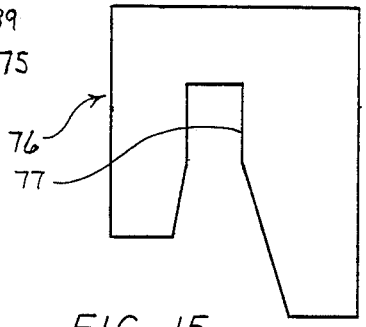
FIG. 15
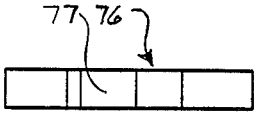
FIG. 17
FIG. 18
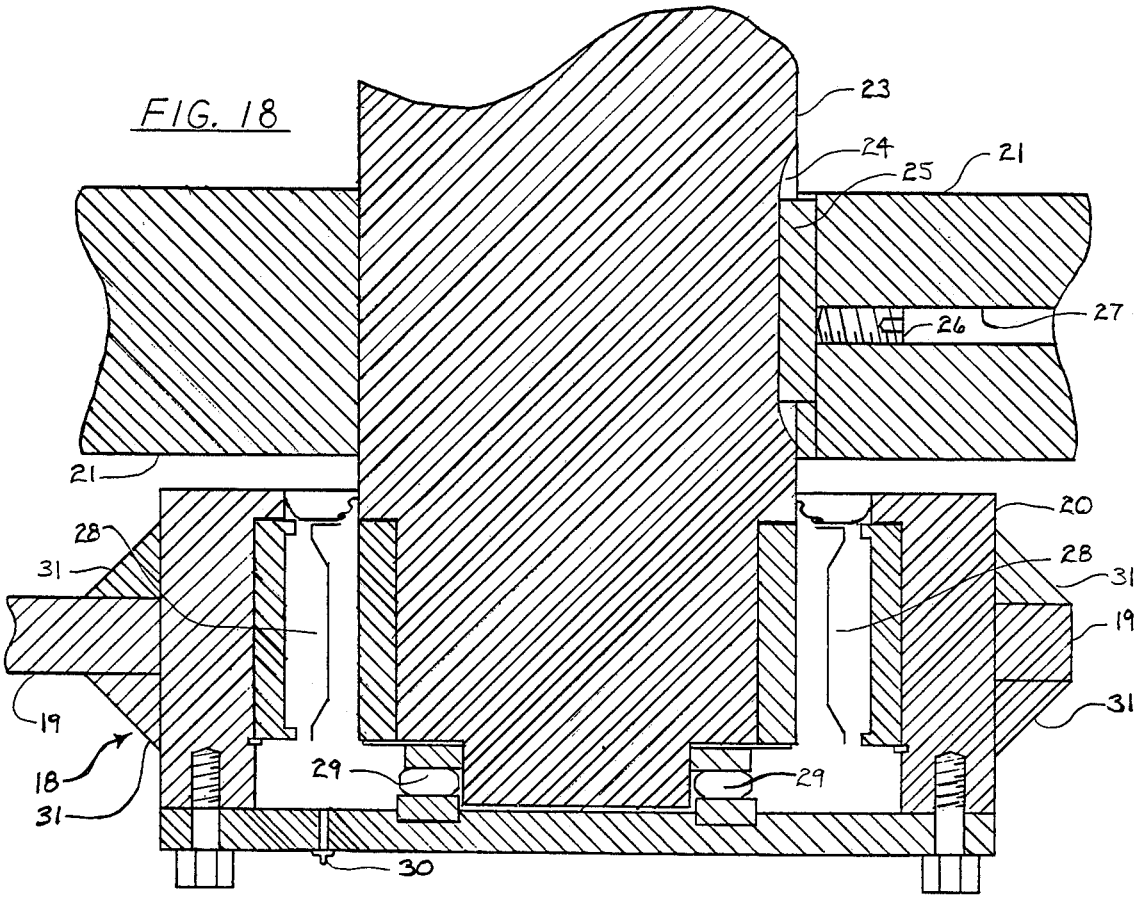

HYDRAULIC PUMP UNIT

BACKGROUND OF THE INVENTION

1. Field of the Invention

This invention relates to pumping units in the oil field and more particularly, to a hydraulic pump unit which is characterized by great efficiency of operation and achievement of optimum well maintenance in pumping oil from oil bearing strata. The hydraulic pump unit of this invention includes a support frame which is slidably mounted on a push-off tray and can be displaced away from the well head by a hydraulic cylinder in order to perform necessary maintenance on the well. The unit effects pumping of oil from the well by means of a pair of hydraulic cylinders attached to a traveling head assembly which carries a pair of rollers and a pair of matching chains mounted on the rollers and attached to the polish rod by means of a bridle. The hydraulic cylinders operate to lift the polish rod by moving the head assembly upward and causing the chains to traverse the rollers. The hydraulic pump unit of this invention is rugged, yet efficient, and is easily installed and removed from the well site.

2. Description of the Prior Art

Pumping units used to pump oil from oil-bearing strata or intervals in the oil field have been known for years. Such pumping units are typically characterized by a drive means or motive force such as an electric motor or diesel engine which cooperates with the drive pulley of single, double and triple reduction gear units to effect pivotal motion of a generally horizontally-disposed walking beam and a horsehead. This movement of the horsehead and walking beam in turn causes a wire-line bridle attached to a string of sucker rods located in the well to reciprocate and pump oil from the strata. The gear box typically carries a pair of cranks and cooperating pistons which are pivotally attached to the walking beam and cause the walking beam horsehead to reciprocate at a selected rate. Conventional pumping units and particularly, conventional gear-reducing units provided in pumping units for transmission of primary drive power to the pitmans and the walking beam at a controlled rate are relatively complex devices generally characterized by multiple gears in an enclosed housing and partially immersed in a pool of oil for lubrication. As long as the oil is maintained at the proper level within the housing the slow speed gear of the gear reducing units is partially immersed in the oil and receives and disburses continuous lubrication. In most cases the lubricating oil composition in the gear reducing unit must be carefully prescribed for any given installation. In any case the lubricating oil level must be maintained above the low mark in the oil-indicating gage, but should not be filled above the high mark. Furthermore, at least every six months the operator must collect a sample of the oil and check it for possible dirt, sludge, water emulsion or other forms of contamination. Due to the complexity of the commonly used herringbone gear units, if a gear breaks or the unit fails for other reasons, such as lack of sufficient lubricating oil or oil of a particular composition, the pumping unit is rendered inoperative until the gear reducing unit is replaced or the defective part is replaced in the unit. Furthermore, both the high speed and the low speed gears in conventional gear reducers, as well as other parts in these units are quite expensive and add significantly to the cost of maintaining and operating the pumping units over a period of time. Failure of gears and gear reducing units is quite common due to the lack of resistance to shock and the large load applied to the engaged teeth.

Other pumping units known in the prior art and used in the oil field include units which are driven by hydraulic cylinders instead of the motor driven gear box type unit described above. These units are designed to eliminate the high cost of operation inherent in the gear box machines, and in many instances are superior to such conventional installations using these gear systems.

Accordingly, it is an object of this invention to provide a hydraulic pump unit which is characterized by great efficiency and utility and which includes a slidably mounted support frame which permits the pump unit to be moved temporarily away from the well head during periods of maintenance on the well.

Another object of this invention is to provide a new and improved hydraulic pump unit which is characterized by a pair of hydraulic cylinders for lifting a slidably-mounted head assembly which utilizes a pair of rotatably-mounted chains to lift the polish rod, sucker rods and pump responsive to operation of the cylinders in order to pump oil from the well.

Still another object of the invention is to provide an improved pumping unit of the hydraulic cylinder design which includes a movable support frame; a stationary mast mounted on the support frame and slidably receiving a traveling mast; a pair of rotating wheels mounted on the traveling mast and fitted with a pair of chains having one end connected to the stationary mast and the opposite end to a bridle which carries the polish rod for pumping oil in the well; and further including a pair of hydraulic cylinders operable to periodically extend the traveling mast on the stationary mast and lift the polish rod as the chains rotate on the rollers, to pump oil from the well.

A still further object of the invention is to provide a new and improved hydraulic pump unit for pumping oil from oil-bearing strata in a well, which pump unit includes a support frame slidably mounted on a cooperating push-off tray whereby the frame and pumping unit can be displaced on the tray to allow access to the well head for maintaining the well; a stationary mast vertically mounted on the support frame and slidably carrying a traveling mast; a head assembly mounted on the traveling mast and characterized by a pair of rotatably-mounted rollers carrying chains, the chains each having one end connected to the stationary mast and the opposite end attached to a bridle supporting a polish rod which extends into the well; and a pair of hydraulic cylinders cooperating with the head assembly whereby extension of the pistons in the hydraulic cylinders lifts the head assembly and the traveling mast and causes the chains to traverse the rollers to lift the polish rod and the attached sucker rod string and well pump, and pump oil from the well.

Still another object of the invention is to provide a simple, yet rugged and dependable hydraulic pump unit for pumping oil from oil-bearing strata in an oil well which combines the simplicity of dual hydraulic cylinder operation with the dependability of a chain and roller-operated sucker rod string and the feature of displacing the supporting frame and pump unit on a stationary carrying tray to maintain the well.

SUMMARY OF THE INVENTION

These and other objects of the invention are provided in a new and improved hydraulic pump unit, which in a preferred embodiment is characterized by a support frame that is slidably mounted on a stationary push-off tray to facilitate displacement of the frame with respect to the tray and movement of the hydraulic pump unit away from the well head when it is necessary to perform maintenance on the well. The hydraulic pump unit further includes a vertically-oriented stationary mast attached to the support frame and a vertical traveling mast slidably cooperating with the stationary mast and fitted with a head assembly which rotatably carries a pair of rollers and cooperating chains mounted on the rollers, the chains each having one end secured to the stationary mast and the opposite end to a bridle, which carries a polish rod extending into the well head. A pair of hydraulic cylinders mounted on the support frame and attached to the head assembly serve to lift the head assembly, the traveling mast and the string of sucker rods and oil in the well as the head assembly moves upwardly and the chains traverse the rollers and lift the polish rod in the well head.

BRIEF DESCRIPTION OF THE DRAWINGS

The invention will be better understood by reference to the accompanying drawings, wherein:

FIG. 14 is a side elevation of a pump unit anchor for securing the hydraulic pump unit frame to the push-off tray;

FIG. 15 is a side elevation of a tray clamp for registering with the pump unit anchor;

FIG. 16 is a top elevation of the pump unit anchor illustrated in FIG. 14;

FIG. 17 is a front end elevation of the tray clamp illustrated in FIG. 15;

FIG. 18 is a sectional view, taken along lines 18—18 in FIG. 4 of a chain roller and roller shaft, more particularly illustrating a preferred mounting of the chain rollers on the roller shaft in the head assembly of the hydraulic pump unit;

DESCRIPTION OF THE PREFERRED EMBODIMENTS

Figure 1:
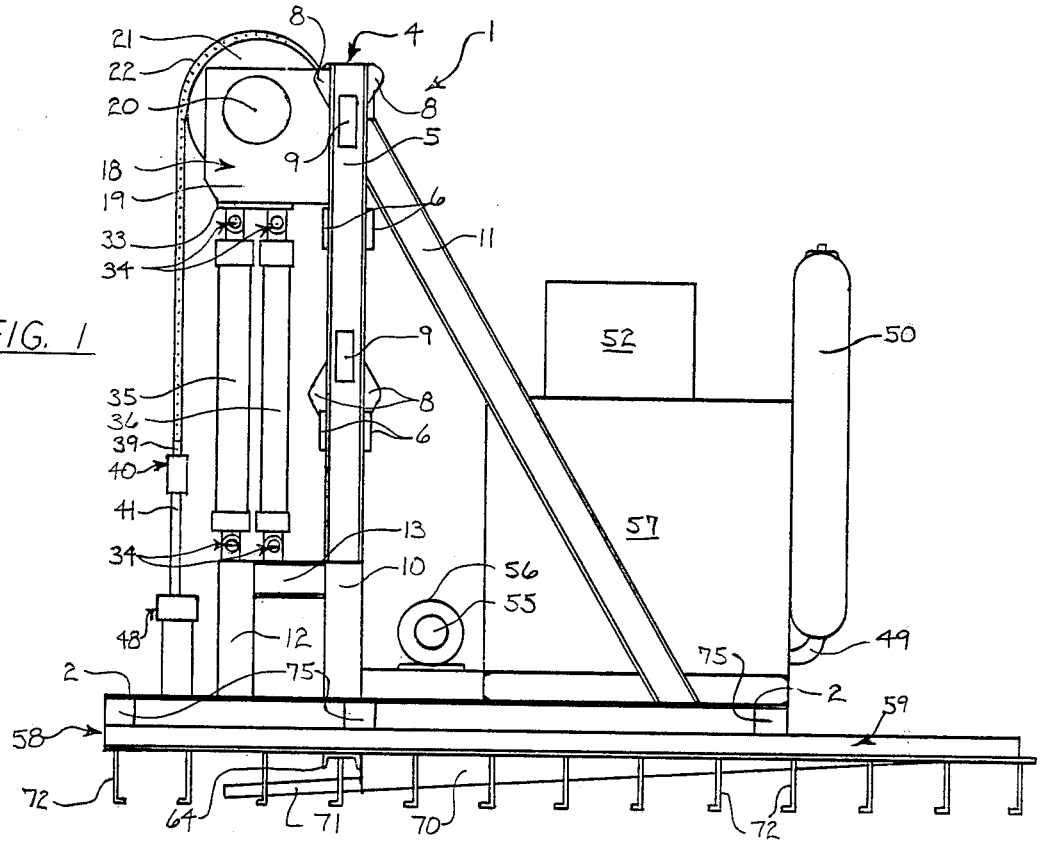
FIG. 1 is a left side elevation of a preferred embodiment of the hydraulic pump unit of this invention with the unit in downstroke pumping configuration.
Figure 2:
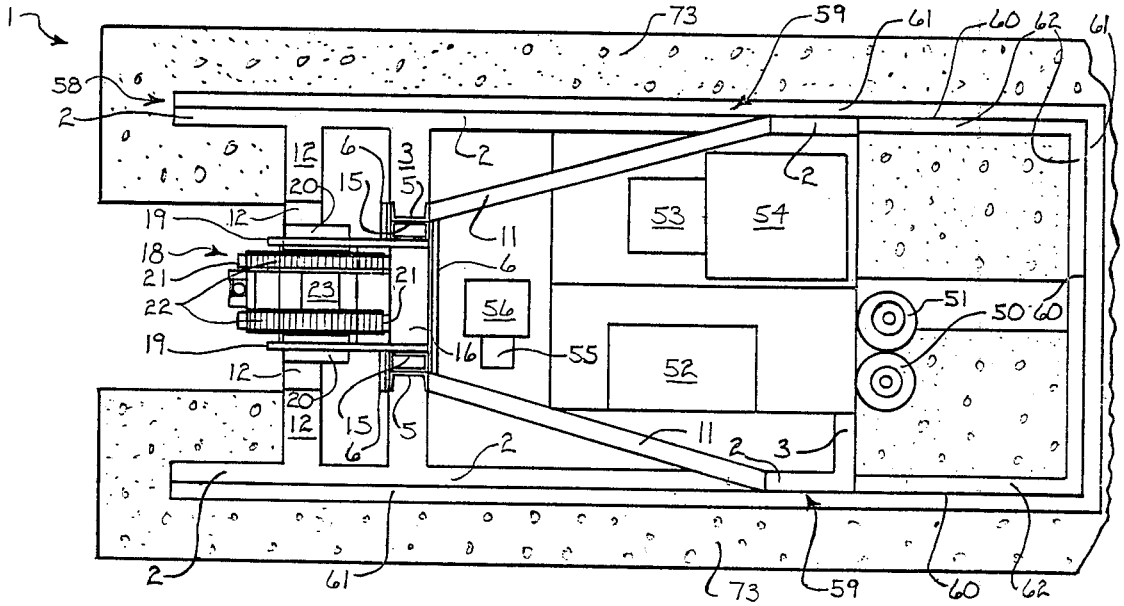
FIG. 2 is a top elevation of the hydraulic pump unit illustrated in FIG. 1.
Figure 3:
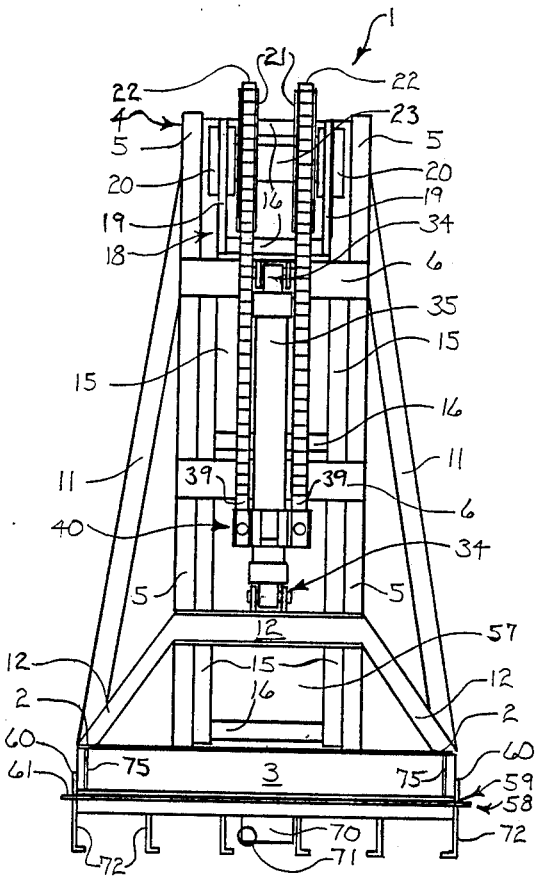
FIG. 3 is a front elevation of the hydraulic pump unit illustrated in FIGS. 1 and 2, with the polish rod and well head removed for clarity.
Figure 4:
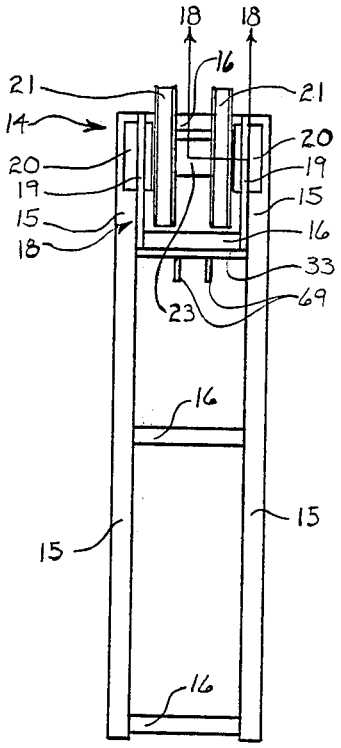
FIG. 4 is a front elevation of the traveling mast component of the hydraulic pump unit.
Figure 7:
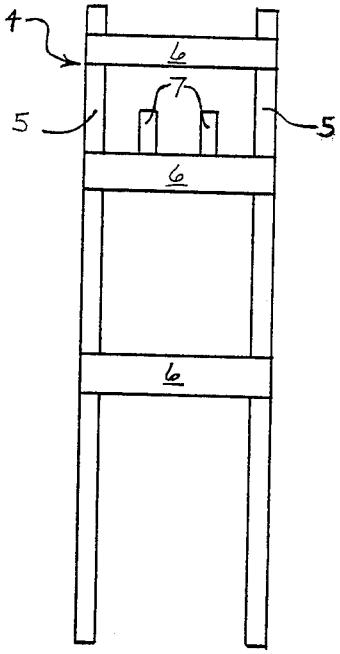
FIG. 7 is a front elevation of the stationary mast component of the hydraulic pump unit.

Referring now to FIGS. 1–4 and 7 of the drawings, the hydraulic pump unit of this invention is generally illustrated by reference numeral 1, and includes as a base or support frame, a pair of generally horizontally disposed side frame members 2, positioned in spaced, parallel relationship and joined by cross frame members 3, as illustrated in FIG. 2. A stationary mast 4, more particularly illustrated in FIG. 7, is situated in vertical relationship on a stationary mast support 10, which extends upwardly from one of the cross frame members 3, as illustrated. Stationary mast 4 includes a pair of spaced stationary mast beams 5, joined by stationary mast braces 6, and is supported in vertical position by a pair of rear braces 11, as illustrated in FIG. 1. A traveling mast 14, more particularly illustrated in FIG. 4, is slidably mounted between stationary mast beams 5 of stationary mast 4, and is secured in position by bearings located in eccentric cam follower bearing housings 8 and non-eccentric cam follower bearing housings 9, as hereinafter described. Traveling mast 14 includes a pair of spaced traveling mast beams 15, joined by traveling mast braces 16, as illustrated in FIG. 4. It will be appreciated from a consideration of FIGS. 1–3 that when hydraulic pump unit 1 is in the extreme downstroke pumping position the top of traveling mast 14 is substantially in alignment with the top of stationary mast 4. A head assembly is generally illustrated by reference numeral 18 and is mounted on the top of traveling mast 14, and includes a pair of spaced bearing mount plates 19, secured to traveling mast beams 15, and a pair of chain rollers 21, which are rotatably mounted on a roller shaft 23, each end of which is carried by a main bearing housing 20. Each main bearing housing 20 is secured to a bearing mount plate 19, and a pair of chains 22 are in turn carried by chain rollers 21, and one end of each of the chains 22 is attached to the chain anchors 7, secured to stationary mast 4, as illustrated in FIG. 7. The opposite end of chains 22 are secured to chain hangers 39 of a bridle 40, which support polish rod 41 and a sucker rod string in the well, as hereinafter more particularly described.

The head assembly 18 and traveling mast 14 are caused to reciprocate on stationary mast 4 by means of a sucker rod cylinder 35 and a fluid column cylinder 36, the bottoms of which cylinders are attached to cylinder brace 12 and cylinder support 13, respectively, by means of spherical bearings 34, as illustrated in FIG. 1. The sucker rod cylinder piston 37 of sucker rod cylinder 35, and the fluid column cylinder rod piston 38 of fluid column cylinder 36 are in turn attached to the head assembly 18 by means of bearing mount plate 33, piston mount cleats 69 and additional spherical bearings 34. Spherical bearings 34 are preferred in the hydraulic cylinder installation to correct slight misalignment of the cylinders during the pumping operation. In one embodiment of the invention a sucker rod cylinder accumulater 50 and fluid column cylinder accumulater 51 are mounted on hydraulic fluid reservoir 57, and are connected by an accumulator line 49, which communicates with hydraulic fluid reservoir 57, and serves to enclose hydraulic fluid lines for the operation of sucker rod cylinder 35 and fluid column cylinder 36 as hereinafter described.

An oil cooler 52 is provided in order to keep the hydraulic fluid in sucker rod cylinder accumulater 50, fluid column cylinder accumulater 51, sucker rod cylinder 35 and fluid column cylinder 36 at a suitable temperature. Furthermore, hydraulic pump 53 and the cooperating hydraulic motor 54 serve to pump hydraulic fluid to sucker rod cylinder accumulater 50 and fluid column cylinder accumulator 51, as hereinafter described.

Figure 5:
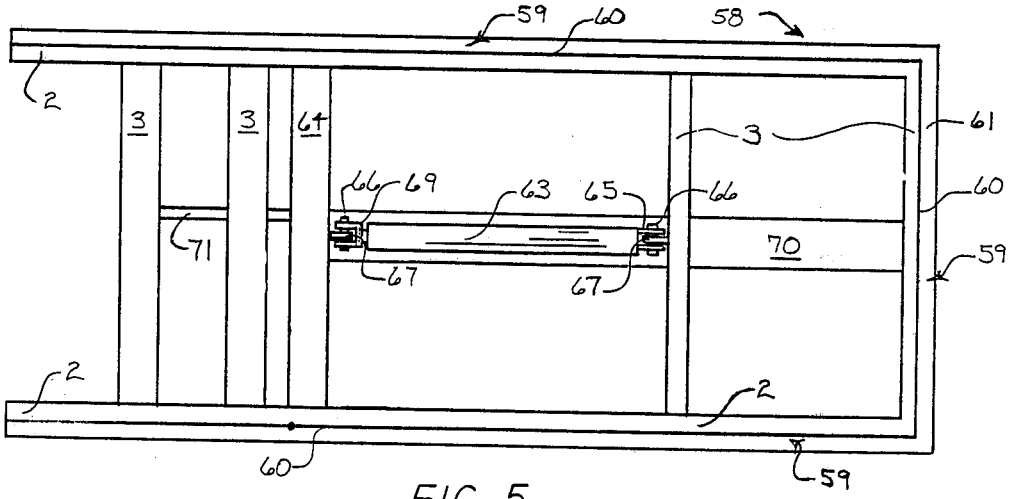
FIG. 5 is a top elevation of the support frame and push-off tray with the frame in retracted configuration.
Figure 6:
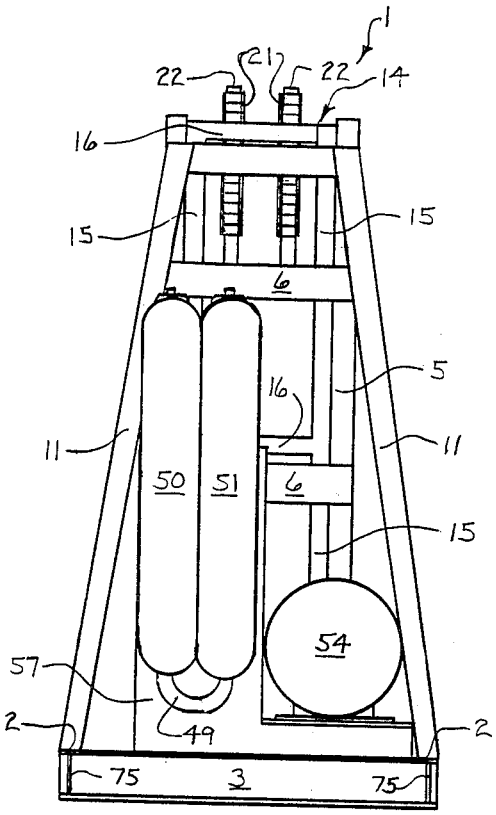
FIG. 6 is a rear elevation of the hydraulic pump unit illustrated in FIGS. 1–3.
Figure 8:
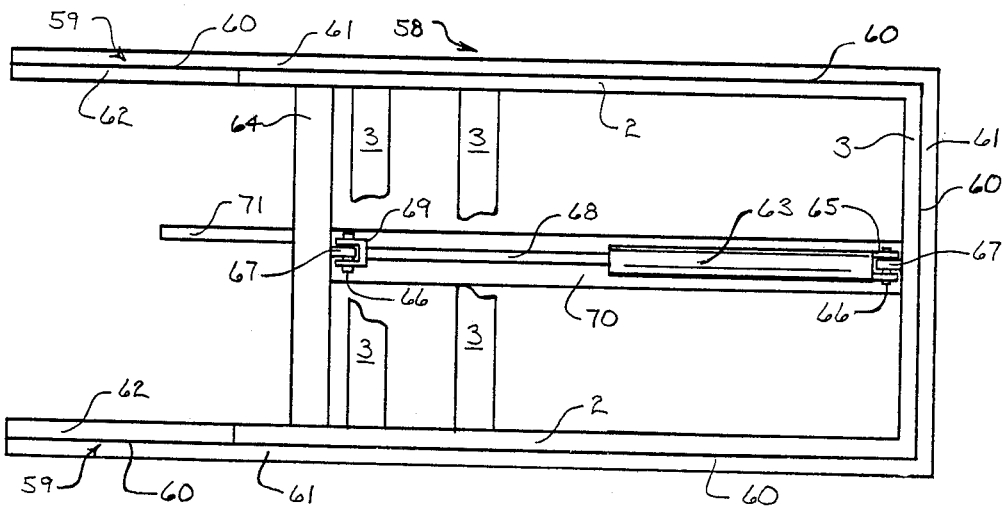
FIG. 8 is a top elevation, partially in section, of the support frame and push-off tray illustrated in FIG. 5, with the hydraulic cylinder in extended configuration and the frame displaced with respect to the push-off tray.
Figure 13:
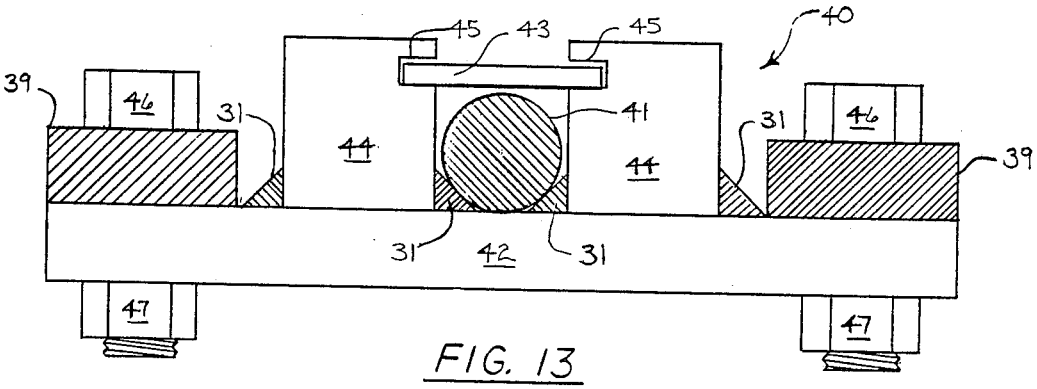
FIG. 13 is a sectional view taken along lines 13—13 in FIG. 11, more particularly illustrating a preferred bridle arrangement for supporting the chains and polish rod in the hydraulic pump unit.

Referring again to FIGS. 1–3 and also to FIGS. 5 and 8 of the drawings, in a preferred embodiment of the invention the side frame member 2 and the cooperating cross frame members 3 which serve as a frame support base for the pumping unit are slidably disposed in a tray frame member 59 of a push-off tray 58, which is preferably shaped in the form of a T to define a vertical web 60, an outside web 61, and a slide web 62, which slide web 62 accomodates side frame member 2 and the end one of cross frame members 3, as illustrated in FIG. 8. Tray frame member 59 is further provided with a connecting push-off hydraulic cylinder mount 64, to which is attached a mount bracket 67, and carries the cylinder housing end of a push-off hydraulic cylinder 63 by means of a piston mount cleat 69 and a cooperating cleat pin 66. The push-off hydraulic cylinder piston 68 of push-off hydraulic cylinder 63 is in turn attached to one of cross frame members 3 by means of an additional mount bracket 67 and a cooperating cylinder mount cleat 65, provided with a cleat pin 66, as illustrated in FIGS. 5 and 8. Push-off hydraulic cylinder 63 is operated by a push-off frame pump 55 and a push-off frame pump motor 56, illustrated in FIGS. 1 and 2, when it is desired to move the pump unit away from well head 48 to perform maintenance on the well, as hereinafter described. Referring now to FIGS. 8 and 13 of the drawings, when it is desired to dismantle the bridle 40 and remove polish rod 41 from the hydraulic pump unit 1 to perform maintenance on the well, the polish rod retainer 43 is removed from retainer blocks 44 and hydraulic pump unit 1 can be displaced away from well head 48 by activating push-off hydraulic cylinder 63 and displacing the side frame members 2 and the cross frame members 3 with the pump unit mounted thereon away from well head 48 into an extended configuration, as illustrated in FIG. 8. Realignment of hydraulic pump unit 1 can be easily achieved by simply reversing this procedure and again operating push-off hydraulic cylinder 63 to force the side frame members 2 and cross frame members 3 back into the retracted configuration illustrated in FIG. 5. Bridle 40 and polish rod 41 can then be reassembled in the configuration illustrated in FIGS. 1 and 13.

In yet another preferred embodiment of the invention, and referring again to FIGS. 1 and 2, the push-off tray 58 is mounted on a concrete pad 73 by means of multiple concrete anchors 72, and includes a sump 70, built into concrete pad 73 and provided with a sump drain 71 for draining water and other fluids from the area surrounding push-off hydraulic cylinder 63 to minimize corrosion of hydraulic cylinder 63.

Figure 9:
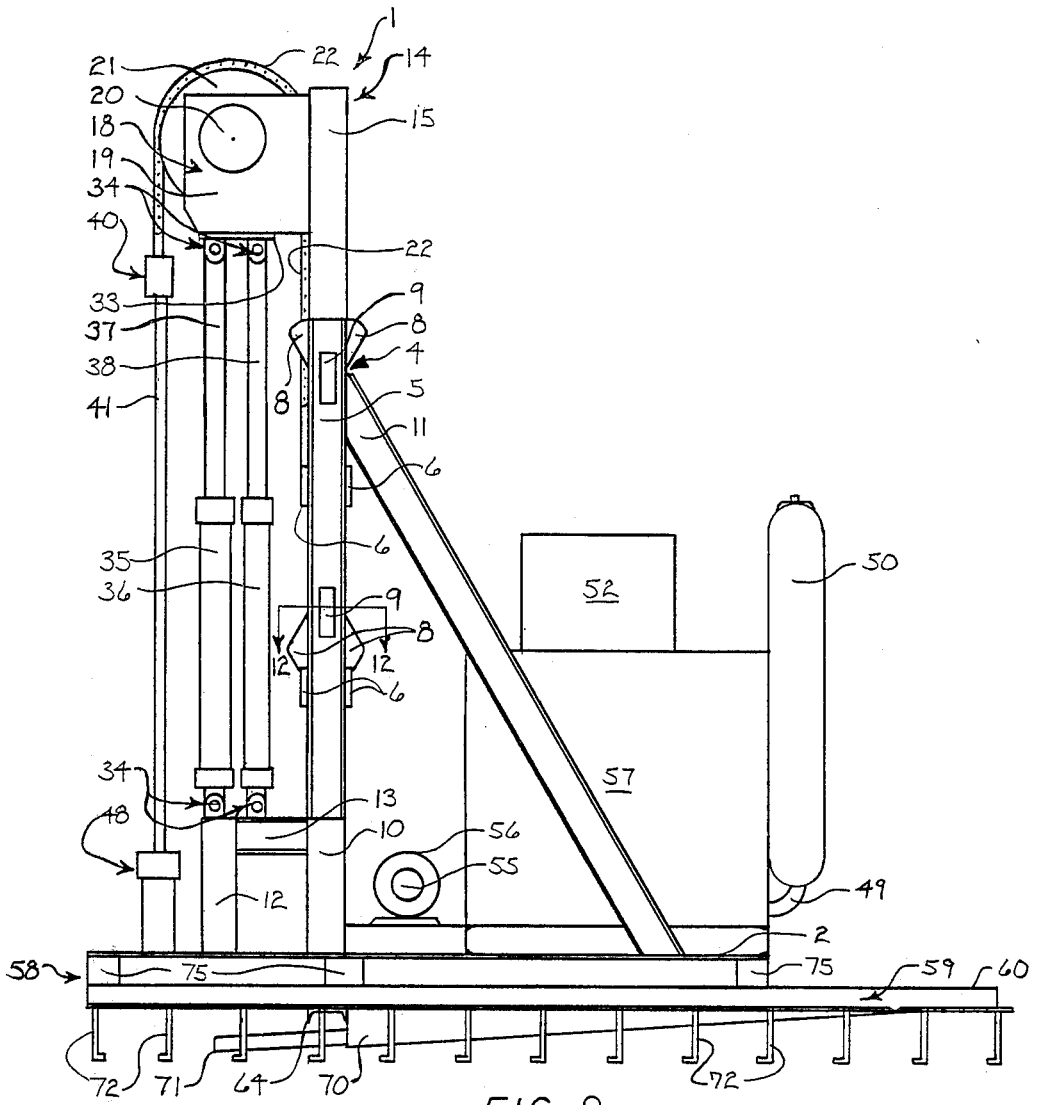
FIG. 9 is a right side elevation of the hydraulic pump unit illustrated in FIG. 1 with the unit in extended, upstroke pumping configuration.
Figure 11:
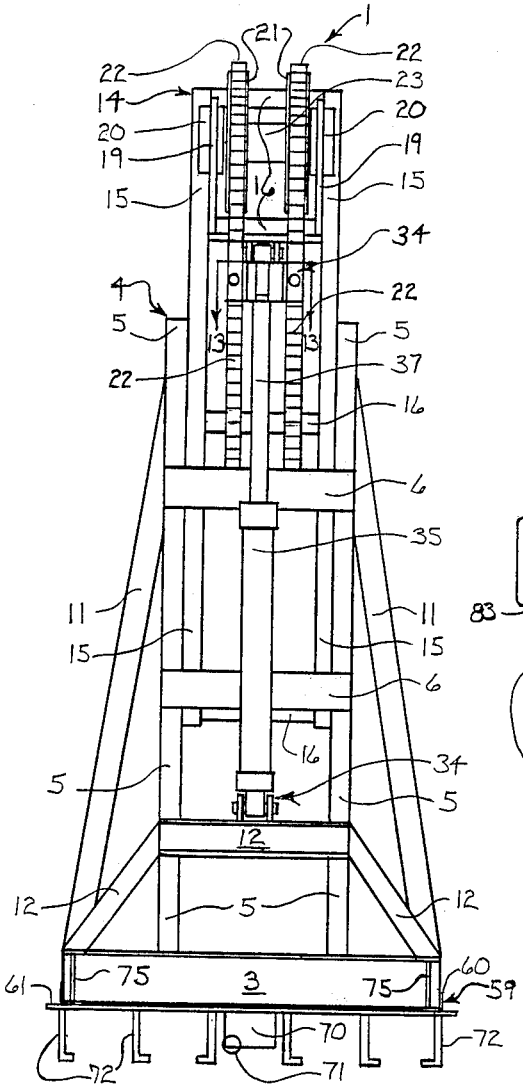
FIG. 11 is a front elevation of the hydraulic pump unit illustrated in FIG. 3 in extended, upstroke pumping configuration.

Referring now to FIGS. 9 and 11 of the drawings, the hydraulic pump unit 1 is in the extended upward pumping stroke, or upstroke configuration with the polish rod 41 extended from well head 48, and chains 22 rotated on chain rollers 21 to extend traveling mast 14 and head assembly 18 upwardly responsive to the extension of sucker rod cylinder 35 and fluid column cylinder 36.

It will be appreciated that a pair of hydraulic cylinders are preferred in the operation of hydraulic pump unit 1 since sucker rod cylinder 35 is designed primarily to lift the weight of the sucker rod string in the well and the weight of the head assembly 18 and traveling mast 14. Furthermore, fluid column cylinder 36 is simply designed to offset the weight of the column of fluid being pumped in the well, and serves to assist the sucker rod cylinder 35. Accordingly, in a preferred embodiment of the invention sucker rod cylinder 35 is somewhat larger than fluid column cylinder 36 in order to perform the above described functions. In another most preferred embodiment the length of chains 22, the stroke of sucker rod cylinder 35 and fluid column cylinder 36, and the sizing of chain rollers 21 are determined in order to achieve a 2:1 ratio of chain travel to linear movement of the traveling mast 14. Accordingly, for each foot of linear travel of traveling mast 14 with respect to stationary mast 4, chains 22 move two feet on chain rollers 21 in order to effect pumping of oil from the well in an optimum and efficient manner. It has been found that this 2:1 ratio is extremely important in maintaining a smooth and optimum pumping sequence by operation of sucker rod cylinder 35 and fluid column cylinder 36.

Figure 10:
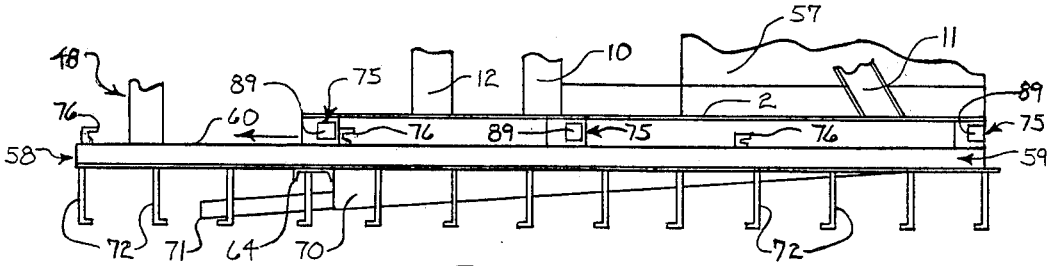
FIG. 10 is a side elevation, partially in section, of the supporting frame displaced with respect to the push-off tray, as illustrated in FIG. 8.

Referring now to FIGS. 5, 8, 10 and 14–17 of the drawings in yet another preferred embodiment of the invention side frame members 2 aand cross frame members 3 are removably secured in the retracted position on push-off tray 58 as shown in FIG. 5, by means of tray clamps 76, secured to tray frame member 59 and adapted to engage cooperating pump unit anchors 75, whih are attached to side frame membes 2, as illustrated in FIG. 10. For explanation purposes and clarity the outside ones of pump unit anchors 75 on the left one of frame members 2 are removed, illustrating the opposite pump unit anchor counterparts mounted to the right one of frame members 2 of hydraulic pump unit 1. Accordingly, when the side frame members 2 and cross frame members 3 are displaced forwardly in push-off tray 58 as indicated by the arrow in FIG. 10 to the retracted configuration shown in FIG. 5, the pump unit anchors 75 engage the tray clamps 76 and secure side frame members 2 and cross frame members 3 tightly to push-off tray 58. The facility for this engagement is more particularly illustrated in FIGS. 14–17, where it is shown that the tray clamp slot 77 of tray clamp 76 is designed to receive an anchor locking pin 90 of pump unit anchor 75 to secure the hydraulic pump unit 1 in place. Each anchor base 88 of pump unit anchors 75 is welded or otherwise attached to side frame members 2 and is fitted with spaced anchor locking pins 90, and a cooperating anchor cap, 89, as illustrated in FIGS. 14 and 16.

Figure 12:
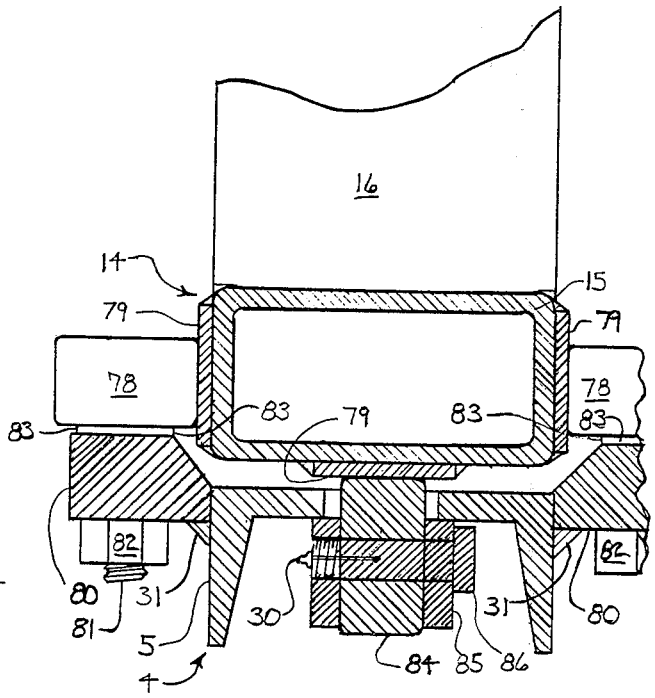
FIG. 12 is a sectional view taken along lines 12—12 in FIG. 9, more particularly illustrating a preferred bearing system for stabilizing the traveling mast with respect to the stationary mast during movement of the traveling mast.

Referring now to FIG. 12 of the drawings in another preferred embodiment of the invention the traveling mast 14 is secured in slidable alignment with the stationary mast 4 by means of eccentric cam follower bearings 78, positioned on each side of each of the traveling mast beams 15. Eccentric cam follower bearings 78 are located inside eccentric cam follower bearing housings 8, and are positioned in contact with wear plates 79 to maintain traveling mast beams 15 in proper lateral alignment. Each set of eccentric cam follower bearings 78 are rotatably mounted on eccentric cam follower bearing mounts 80, which are welded or otherwise attached to the stationary mast beams 5 of stationary mast 4. Shaft bushings 83 serve to permit rotation of eccentric cam follower bearings 78 with respect to eccentric cam follower bearing mounts 80, and in a most preferred embodiment of the invention, an eccentric cam follower bearing shaft 81 is attached to each one of eccentric cam follower bearings 78, and is threaded to accommodate a shaft nut 82 in order to secure the eccentric cam follower bearings 78 on the eccentric cam follower bearing mounts 80. In yet another preferred embodiment the eccentric cam follower bearings 78 are secured in eccentric configuration in eccentric cam follower bearing mount 80 to permit adjustment for wear in wear plates 79.

Longitudinal stability of traveling mast 14 with respect to stationary mast 4 is achieved by means of non-eccentric cam follower bearings 84, which are enclosed in non-eccentric cam follower bearing housings 9, and are rotatably carried by non-eccentric cam follower bearing mounts 85 and non-eccentric cam follower bearing pins 86. As in the case of the eccentric cam follower bearings 78, wear plates 79 are attached to traveling mast beam 15 at the points of contact between non-eccentric cam follower bearings 84 and traveling mast beams 15 in order to minimize wear in the traveling mast beams 15. A grease fitting 30 is provided in the end of non-eccentric cam follower bearing pins 86 in order to properly lubricate non-eccentric cam follower bearings 84.

Referring now to FIG. 18 of the drawings in another preferred embodiment of the invention the chain rollers 21 are mounted to roller shaft 23 by means of a roller key slot 24 and a cooperating roller key 25, with an optional set screw 26 provided in a set screw aperture 27 in chain rollers 21 to maintain chain rollers 21 tightly on roller shaft 23. Furthermore, each of the main bearing housings 20 mounted in bearing mount plates 19, contain roller shaft bearing apertures 28 for receiving roller shaft bearings [not illustrated]. These roller bearings are designed to stabilize roller shaft 23 and provide uninhibited rotation of chain rollers 21 in main bearing housings 20. Furthermore, roller shaft thrust bearings 29 are also provided in the ends of main bearing housings 20 in order to compensate for the thrust of roller shaft 23 and further contribute to the ease of rotation of roller shaft 23 in main bearing housings 20. Welds 31 further serve to securely mount main bearing housings 20 on bearing mount plates 19, and also serve to join the component parts of other portions of the hydraulic pump unit 1 together.

Referring again to FIG. 13 of the drawings in another preferred embodiment of the invention the bridle 40 includes a bridle plate 42, having a pair of retainer blocks 44 mounted thereon and provided with a retainer slot 45 for receiving a polish rod retainer 43, in order to maintain the polish rod 41 between retainer blocks 44 and against bridle plate 42 and welds 31, as heretofore described. Chain hangers 39 are attached to bridle plate 42 by means of plate bolts 46 and cooperating plate nuts 47, and serve to attach chains 22 to bridle plate 42.

Figure 19:
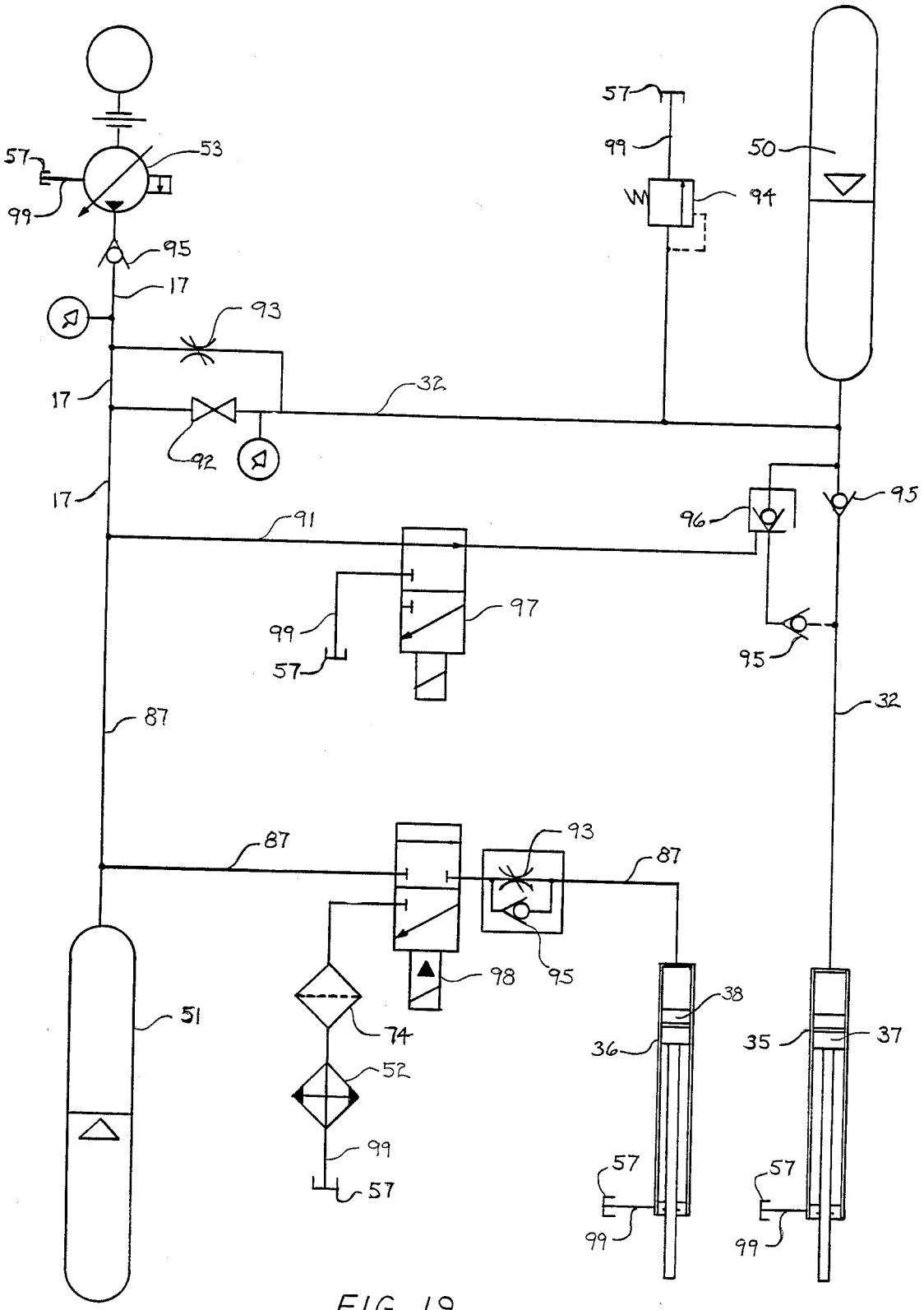
FIG. 19 is a schematic of a hydraulic system for operating the hydraulic pump unit.

Referring now to FIG. 19, a schematic of a preferred hydraulic system is illustrated for hydraulic pump unit installations where power is not available in large quantities at the well location. Accordingly, the system is designed to provide essentially constant electrical loading at low amperage using a limited power supply. Under these circumstances hydraulic pump 53 is characterized as a variable volume, pressure compensating pump and discharges into a header line 17, with a storage tank or reservoir line 99 connecting hydraulic fluid reservoir 57 to the suction of hydraulic pump 53. Other reservoir lines 99 connect various components of the system to hydraulic fluid reservoir 57, as illustrated. A sucker rod cylinder accumulator line 32 connects to header line 17 and extends into sucker rod cylinder accumulator 50, with a relief valve 94 installed in sucker rod cylinder accumulator line 32 to relieve excess pressure in the system. A check valve 95 is also installed in header line 17 to prevent damage to hydraulic pump 53 in the event of a pressure surge in sucker rod cylinder accumulator line 32. Sucker rod cylinder accumulator line 32 also extends from sucker rod cylinder accumulator 50 to sucker rod cylinder 35, and a pair of check valves 95 are installed in the line in parallel with a pilot check valve 96 to selectively allow hydraulic fluid to flow from sucker rod cylinder accumulator 50 to sucker rod cylinder 35. In a preferred embodiment of the system a supply valve 92 and a metering valve 93 are also provided in sucker rod cylinder accumulator line 32 to charge and isolate the sucker rod cylinder accumulator 50 from the rest of the hydraulic system and to meter small quantities of hydraulic fluid into sucker rod cylinder 35 in order to replace fluid losses during operation of the sucker rod cylinder 35, respectively. A small 3-way valve 97 is provided in cooperation with the pilot check valve 96 to periodically hydraulically activate the valve, and a large 3-way valve 98 electrically operates the small 3-way valve 97 according to a preselected timing sequence, as hereinafter described. A hydraulic control line 91 extends from header line 17 to small 3-way valve 97, and to pilot check valve 96 to facilitate hydraulic control of pilot check valve 96.

A fluid column cylinder accumulator line 87 also connects to header line 17 and extends from this connection to fluid column cylinder accumulator 51, and to large 3-way valve 98 and fluid column cylinder 36. Accordingly, hydraulic fluid can be pumped to fluid column cylinder accumulator 51, and to fluid column cylinder 36, responsive to the operation of large 3-way valve 98, as hereinafter described. Hydraulic fluid in the system is filtered through filter 74 and cooled by passage through cooler 52, as desired. In another preferred embodiment, a metering valve 93 and a check valve 95 are installed in parallel relationship in fluid column cylinder accumulator line 87 to further control the flow of hydraulic fluid to and from fluid column cylinder 36.

Figure 20:
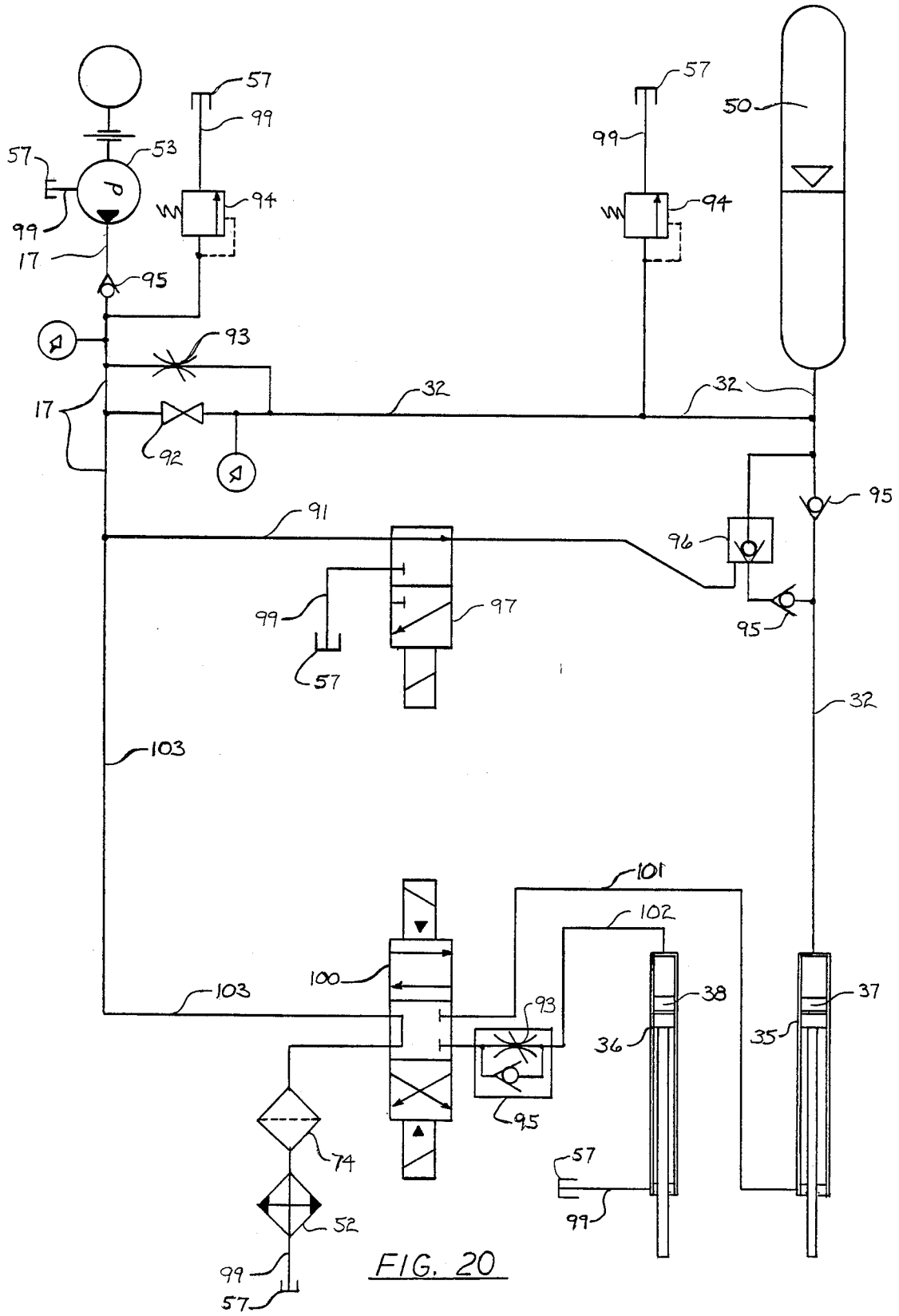
FIG. 20 is a schematic of an alternative hydraulic system for operating the hydraulic pump unit of this invention.

Referring now to FIG. 20, an alternative hydraulic cylinder control circuit is illustrated in schematic form, and is designed for use on well sites where ample power is available. This control circuit utilizes a higher current consumption at peak loading, and the power loading varies with each pumping stroke. Accordingly, in this embodiment of the invention hydraulic pump 53 is characterized as a gear or pump, and a single sucker rod cylinder accumulator 50 is used in the system to accommodate both sucker rod cylinder 35 and fluid column cylinder 36. Sucker rod cylinder accumulator line 32 hydraulically connects the sucker rod cylinder accumulator 50 to the header line 17, which cooperates with the discharge of hydraulic pump 53. Hydraulic control line 91 connects header line 17 with small 3-way valve 97 and pilot check valve 96, to facilitate hydraulic opening and closing of pilot check valve 96 responsive to operation of small 3-way valve 97. Check valves 95 are also positioned in sucker rod cylinder accumulator line 32 in both parallel and in series relationship with pilot check valve 96 in order to control the flow of hydraulic fluid to and from sucker rod cylinder accumulator 50. Sucker rod cylinder accumulator line 32 also extends to one end of sucker rod cylinder 35, while a 4-way valve cylinder line 101 extends from the opposite end of sucker rod cylinder 35 to 4-way valve 100. A fluid column cylinder line 102 also extends from one end of fluid column cylinder 36 to 4-way valve 100, and a metering valve 93 and a check valve 95 are installed in parallel configuration in fluid column cylinder line 102. A 4-way valve supply line 103 also extends from 4-way valve 100 to header line 17, as illustrated.

In operation, and referring again to FIGS. 1 and 3, when hydraulic pump unit 1 is in the downstroke configuration pumping of oil from oil-bearing strata in a well is effected as follows. Under circumstances where the hydraulic system used to control the pumping sequence is as illustrated in FIG. 19, and hydraulic pump 53 is characterized as a variable volume, pressure compensating pump, supply valve 92 is initially opened to allow hydraulic fluid to flow through header line 17 and sucker rod cylinder accumulator line 32 into sucker rod cylinder accumulator 50. When sucker rod cylinder accumulator 50 is charged with hydraulic fluid to a desired pressure, supply valve 92 is closed. As hydraulic pump 53 continues to operate, hydraulic fluid is also pumped through fluid column cylinder accumulator line 87 and into fluid column cylinder accumulator 51, until the desired pressure is reached. At this point fluid column cylinder accumulator 51 is charged to a pressure which is sufficient to provide at least 50% of the necessary volume of hydraulic fluid to achieve one complete upward stroke of fluid column cylinder rod piston 38 in fluid column cylinder 36. Hydraulic fluid is also pumped through hydraulic control line 91 and small 3-way valve 97, to pilot check valve 96, and through fluid column cylinder accumulator line 87 and large 3-way valve 98, to fluid column cylinder 36. Hydraulic fluid is supplied to sucker rod cylinder 35 through sucker rod cylinder accumulator line 32; since large 3-way valve 98 and small 3-way valve 97 are open, pressure is allowed to build in sucker rod cylinder 35 and fluid column cylinder 36.

When the hydraulic system illustrated in FIG. 9 is fully charged with hydraulic fluid as described above, and the fluid pressure in sucker rod cylinder 35 exceeds the combined load of the head assembly 18, traveling mast 14, and the sucker rod string in the well, and the pressure in fluid column cylinder 36 exceeds the weight of the column of oil in the well pump at the bottom end of the sucker rod string, sucker rod cylinder piston 37 and fluid column cylinder rod piston 38 begin to move upward. This action causes traveling mast 14 and head assembly 18 to moe responsively upward on stationary mast 4, as chains 22 traverse chain rollers 21. When fluid column cylinder accumulator 51 has discharged the volume of hydraulic fluid accumulated therein to the point where the pressure in fluid column cylinder accumulator 51 is equal to the pressure required to force fluid column cylinder rod piston 38 upwards, hydraulic pump 53 supplies the necessary remaining volume of oil at a sufficient pressure to allow fluid column cylinder rod piston 38 to continue in its upward travel. Meanwhile, the pressure in sucker rod cylinder accumulator 50 is sufficient to drive sucker rod cylinder piston 37 upward at essentially the same rate of travel of fluid column cylinder rod piston 38, for a complete upward stroke. When sucker rod cylinder piston 37 and fluid column cylinder rod piston 38 reach maximum extension as illustrated in FIGS. 9 and 11 of the drawings, large 3-way valve 98 electrically shifts to the downstroke configuration and electrically causes small 3-way valve 97 to do likewise. This action stops the flow of hydraulic fluid and allows the pressure to drop in sucker rod cylinder 35 and fluid column cylinder 36, and permits sucker rod cylinder piston 37 and fluid column cylinder rod piston 38 to telescope into sucker rod cylinder 35 and fluid column cylinder 36, respectively, at a controlled rate dictated by metering valve 93, to control the rate of descent of the sucker rod string and well pump in the well. Retraction of sucker rod cylinder piston 37 and fluid column cylinder rod piston 38 causes hydraulic fluid to flow back through check valve 95 to recharge sucker rod cylinder accumulator 50 and fluid column cylinder accumulator 51. Meanwhile, hydraulic pump 53 continues to pump hydraulic fluid into fluid column cylinder accumulator 51 at a decreasing volume and under increasing pressure conditions until large 3-way valve 98 again shifts to the upstroke configuration as sucker rod cylinder piston 37 and fluid column cylinder piston 38 return to the extreme downstroke position illustrated in FIGS. 1 and 3.

Under circumstances where the hydraulic system used to control the pumping sequence is as illustrated in FIG. 20, and hydraulic pump 53 is characterized as a gear or vane pump, supply valve 92 is again initially opened to allow hydraulic fluid to flow through header line 17 and sucker rod cylinder accumulator line 32 into sucker rod cylinder accumulator 50. Hydraulic fluid also flows from header line 17, through 4-way valve supply line 103 and into 4-way valve 100. When sucker rod cylinder accumulator 50 is charged with hydraulic fluid to a suitable pressure, supply valve 92 is closed, and 4-way valve 100 is energized to permit hydraulic fluid to flow from 4-way valve 100, through fluid column cylinder line 102 and into fluid column cylinder 36. Meanwhile, hydraulic fluid also flows from sucker rod cylinder accumulator 50 through sucker rod cylinder accumulator line 32 and into sucker rod cylinder 35, as 4-way valve 100 electrically energizes small 3-way valve 97, which hydraulically causes pilot check valve 96 to open. When the pressure in sucker rod cylinder 35 and fluid column cylinder 36 is sufficient to raise the sucker rod cylinder piston 37 and the fluid column cylinder rod piston 38 against the respective loads, sucker rod cylinder piston 37 and fluid column cylinder rod piston 38 move upward at essentially the same rate of travel until they reach maximum extension, as illustrated in FIGS. 9 and 11. During this extension of sucker rod cylinder piston 37 and fluid column cylinder piston 38, sucker rod cylinder piston 37 is forced upwardly by pressure in sucker rod cylinder accumulator 50, while pressure on fluid column cylinder rod piston 38 is maintained by hydraulic pump 53. At maximum extension of sucker rod cylinder piston 37 and fluid column cylinder rod piston 38, 4-way valve 100 electrically shifts to the downstroke configuration and electrically causes small 3-way valve to do likewise. This action stops the flow of hydraulic fluid as hydraulic fluid bleeds back through check valve 95, which recharges sucker rod cylinder accumulator 50 and permits sucker rod cylinder piston 37 and fluid column cylinder rod piston 38 to telescope into sucker rod cylinder 35 and fluid column cylinder 36, respectively, at a controlled rate dictated by metering valve 93, to control the rate of descent of the sucker rod string and well pump in the well. As hydraulic pump 53 continues to pressure sucker rod cylinder accumulator 50 through metering valve 93 for the next succeeding pumping stroke, 4-way valve 100 again opens, and the pumping sequence is repeated.

Referring again to FIGS. 19 and 20, it will be appreciated by those skilled in the art that the valve shifts in 4-way valve 100 and large 3-way valve 98 can be electrically adjusted to create a pause of selected duration at the upstroke and downstroke pumping sequences to allow alignment of the sucker rod string. This pause may be different for pumping units on wells of different depths, where sucker rod strings of varying length are used.

While the preferred embodiments of the invention have been described above, it will be recognized and understood that various modifications may be made therein, and the appended claims are intended to cover all such modifications which may fall within the spirit and scope of the invention.

Having described my invention with the particularity set forth above, what is claimed is:

1. A hydraulic pump unit for pumping oil from oil-bearing strata in a well comprising:

(a) a stationary tray mounted on a site pad at a well location;

(b) a support frame slidably mounted on said tray and retracted on said tray while said hydraulic pump unit is in pumping configuration with respect to the well;

(c) a stationary mast vertically mounted on said support frame;

(d) a traveling mast slidably carried by said stationary mast and extensible vertically with respect to said vertical mast;

(e) bearing means carried by said stationary mast and contacting said traveling mast for stabilizing said traveling mast on said stationary mast;

(f) roller means rotatably mounted on said traveling mast near the top of said traveling mast;

(g) at least one chain having one end attached to said stationary mast and the opposite end of said at least one chain engaging said roller means and projecting downwardly in essentially parallel relationship to said stationary mast and said traveling mast;

(h) a bridle attached to said opposite end of said at least one chain and carrying a polish rod extending into the well head of the well; and (i) a first hydraulic cylinder and a second hydraulic cylinder mounted on said support frame and attached to said traveling mast whereby said traveling mast is caused to traverse said stationary mast and said at least one chain traverses said roller means whereby the polish rod is caused to reciprocate in the well head and to pump oil from the well responsive to operation of said first hydraulic cylinder and said second hydraulic cylinder.

2. The hydraulic pump unit of claim 1 wherein said roller means is a first roller and a second roller, and a roller shaft carrying said first roller and said second roller in spaced relationship, said roller shaft journalled for rotation in said traveling mast, and said at least one chain is a first chain engaging said first roller and a second chain engaging said second roller.

3. The hydraulic pump unit of claim 1 wherein said roller means is a first roller and a second roller, and a roller shaft carrying said first roller and said second roller in spaced relationship, said roller shaft journalled for rotation in said traveling mast, and said at least one chain is a first chain engaging said first roller and a second chain engaging said second roller, and further comprising bearing means carried by said stationary mast and contacting said traveling mast for stabilizing said traveling mast on said stationary mast.

4. The hydraulic pump unit of claim 3 further comprising a first hydraulic control system characterized by a hydraulic fluid reservoir; a hydraulic pump cooperating with said reservoir for pumping hydraulic fluid from said reservoir; a header hydraulic conduit connected to the discharge of said pump and a first hydraulic conduit connected to said header hydraulic conduit; a first hydraulic fluid accumulator and said first hydraulic cylinder connected to said first hydraulic conduit whereby hydraulic fluid can be supplied from said reservoir to said first hydraulic fluid accumulator and said first hydraulic cylinder; a metering valve and a supply valve in parallel relationship in said first hydraulic conduit and located between said hydraulic fluid accumulator, for metering hydraulic fluid to said first hydraulic cylinder and charging said first hydraulic fluid accumulator with hydraulic fluid, respectively; a first check valve and a pilot check valve in parallel relationship in said first hydraulic conduit and located between said first hydraulic fluid accumulator and said first hydraulic cylinder, and a second check valve in series with said pilot check valve in said first hydraulic conduit for controlling the direction of flow of said hydraulic fluid in said first hydraulic conduit; a first 3-way valve in hydraulic cooperation with said pilot check valve for opening and closing said pilot check valve; a second hydraulic conduit connected to said header hydraulic conduit; a second hydraulic fluid accumulator and said second hydraulic cylinder connected to said second hydraulic conduit whereby hydraulic fluid can be supplied from said reservoir to said second hydraulic fluid accumulator and said second hydraulic cylinder; a metering valve and a third check valve in parallel relationship to said second hydraulic conduit and located between said second hydraulic fluid accumulator and said second hydraulic cylinder for metering hydraulic fluid to said second hydraulic cylinder; and a second 3-way valve in said second hydraulic circuit and located between said second hydraulic cylinder accumulator and said second hydraulic cylinder, and in electrical cooperation with said first 3-way valve, for controlling the flow of hydraulic fluid to said first hydraulic cylinder and said second hydraulic cylinder and initiating each upstroke and downstroke pumping sequence of said first hydraulic cylinder and said second hydraulic cylinder.

5. The hydraulic pump unit of claim 4 wherein said hydraulic pump is a variable volume, pressure compensating pump, and further comprising a relief valve in said first hydraulic conduit to release excessive pressure in said hydraulic control system; a filter and a hydraulic fluid cooler in said hydraulic control system for filtering and cooling said hydraulic fluid, respectively; and a fourth check valve in said header hydraulic conduit to protect said hydraulic pump.

6. The hydraulic pump unit of claim 3 further comprising a second hydraulic control system characterized by a hydraulic fluid reservoir; a hydraulic fluid pump cooperating with said reservoir for pumping hydraulic fluid from said reservoir; a header hydraulic conduit connected to the discharge of said pump and a first hydraulic conduit connected to said header hydraulic conduit; a hydraulic fluid accumulator and said first hydraulic cylinder connected to said first hydraulic conduit whereby hydraulic fluid can be supplied from said reservoir to said hydraulic fluid accumulator and said first hydraulic cylinder; a metering valve and a supply valve in parallel relationship in said first hydraulic conduit and located between said hydraulic pump and said hydraulic fluid accumulator, for metering hydraulic fluid to said first hydraulic cylinder and charging said hydraulic fluid accumulator with hydraulic fluid, respectively; a first check valve and a pilot check valve in parallel relationship in said first hydraulic conduit and located between said hydraulic fluid accumulator and said first hydraulic cylinder, and a second check valve in series with said pilot check valve in said first hydraulic conduit for controlling the direction of flow of said hydraulic fluid in said first hydraulic conduit; a 3-way valve in hydraulic cooperation with said pilot check valve for opening and closing said pilot check valve; a second hydraulic conduit connected to said header hydraulic conduit; a 4-way valve in said second hydraulic conduit and in electrical cooperation with said 3-way valve to control said 3-way valve; a third hydraulic conduit connecting said 4-way valve and said first hydraulic cylinder, and a fourth hydraulic fluid conduit connecting said 4-way valve and said second hydraulic cylinder; and a metering valve and a third check valve in parallel relationship in said fourth hydraulic conduit for metering hydraulic fluid to said second hydraulic cylinder, whereby said 4-way valve and said 3-way valve electrically open and close to control the flow of hydraulic fluid to said first hydraulic cylinder and said second hydraulic cylinder and control the pumping sequence of said hydraulic pump unit.

7. The hydraulic pump unit of claim 6 wherein said hydraulic pump is a gear pump, and further comprising a relief valve in said first hydraulic conduit to release excessive pressure in said hydraulic control system; a filter and a hydraulic fluid cooler in said hydraulic control system for filtering and cooling said hydraulic fluid, respectively; and a fourth check valve in said header hydraulic conduit to protect said hydraulic pump.

8. A hydraulic pump unit for pumping fluid from a well comprising:

(a) base means;

(b) a stationary mast mounted on said base means in essentially vertical relationship;

(c) a traveling mast slidably carried by said stationary mast in essentially vertical relationship;

(d) roller means rotatably mounted on said traveling mast;

(e) at least one chain having one end attached to said stationary mast and the opposite end of said chain extending over said roller means and projecting downwardly in essentially parallel relationship with respect to said stationary mast and said traveling mast;

(f) bridle means attached to said opposite end of said at least one chain and carrying a polish rod extending into a well head in the well;

(g) a first hydraulic cylinder cooperating with said traveling mast whereby said traveling mast, said roller means, said bridle and said polish rod are sequentially lifted with the sucker rods and pump in the well, and a second hydraulic cylinder cooperating with said traveling mast whereby the fluid in the pump is lifted; said first and second hydraulic cylinder mounted on said base means; and (h) a first hydraulic control system characterized by a hydraulic fluid reservoir; a hydraulic pump cooperating with said reservoir for pumping hydraulic fluid from said reservoir; a header hydraulic conduit connected to the discharge of said pump and a first hydraulic conduit connected to said header hydraulic conduit; a first hydraulic fluid accumulator and said first hydraulic cylinder connected to said first hydraulic conduit whereby hydraulic fluid can be supplied from said reservoir to said first hydraulic fluid accumulator and said first hydraulic cylinder; a metering valve and a supply valve in parallel relationship in said first hydraulic conduit and located between said hydraulic pump and said first hydraulic fluid accumulator, for metering hydraulic fluid to said first hydraulic cylinder and charging said first hydraulic fluid accumulator with hydraulic fluid, respectively; a first check valve and a pilot check valve in parallel relationship in said first hydraulic conduit and located between said first hydraulic fluid accumulator and said first hydraulic cylinder, and a second check valve in series with said pilot check valve in said first hydraulic conduit for controlling the direction of flow of said hydraulic fluid in said first hydraulic conduit; a first 3-way valve in hydraulic cooperation with said pilot check valve for opening and closing said pilot check valve; a second hydraulic conduit connected to said header hydraulic conduit; a second hydraulic fluid accumulator and said second hydraulic cylinder connected to said second hydraulic conduit whereby hydraulic fluid can be supplied from said reservoir to said second hydraulic fluid accumulator and said second hydraulic cylinder; a metering valve and a third check valve in parallel relationship in said second hydraulic conduit and located between said second hydraulic fluid accumulator and said second hydraulic cylinder for metering hydraulic fluid to said second hydraulic cylinder; and a second 3-way valve in said second hydraulic circuit and located between said second hydraulic fluid accumulator and said second hydraulic cylinder, and in electrical cooperation with said first 3-way valve, for controlling the flow of hydraulic fluid to said first hydraulic cylinder and said second hydraulic cylinder and initiating each upstroke and downstroke pumping sequence of said first hydraulic cylinder and said second hydraulic cylinder.

9. The hydraulic pump unit of claim 8 wherein said roller means is a first roller, and a second roller positioned in spaced relationship with respect to said first roller; a generally horizontally-oriented roller shaft carrying said first roller and said second roller in fixed relationship; and shaft bearing means mounted on said traveling mast and carrying said roller shaft in rotatable relationship, and wherein said at least one chain is a first chain in engagement with said first roller and a second chain in engagement with said second roller.

10. The hydraulic pump unit of claim 8 wherein:

(a) said roller means is a first roller, and a second roller positioned in spaced relationship with respect to said first roller; a generally horizontally-oriented roller shaft carrying said first roller and said second roller in fixed relationship; and shaft bearing means mounted on said traveling mast and carrying said roller shaft in rotatable relationship, and wherein said at least one chain is a first chain in engagement with said first roller and a second chain in engagement with said second roller; and (b) said base means is further characterized as a stationary tray and a support frame slidably mounted on said tray and carrying said stationary mast and said lifting hydraulic cylinder means, and whereby said support frame is capable of slidable displacement on said tray to move said stationary mast, said traveling mast, said roller means and said bridle away from the well head and the well.

11. The hydraulic pump unit of claim 8 wherein:

(a) said roller means is a first roller, and a second roller positioned in spaced relationship with respect to said first roller; a generally horizontally-oriented roller shaft carrying said first roller and said second roller in fixed relationship; and shaft bearing means mounted on said traveling mast and carrying said roller shaft in rotatable relationship, and wherein said at least one chain is a first chain in engagement with said first roller and second chain in engagement with said second roller; and (b) said base means is further characterized as a stationary tray and a support frame slidably mounted on said tray and carrying said stationary mast, said first hydraulic cylinder and said second hydraulic cylinder, and whereby said support frame is capable of slidable displacement on said tray to move said stationary mast, said traveling mast, said roller means and said bridle away from the well head and the well.

12. The hydraulic pump unit of claim 11 wherein said hydraulic pump is a variable volume, pressure compensating pump, and further comprising a relief valve in said first hydraulic conduit to release excessive pressure in said hydraulic control system; a filter and a hydraulic fluid cooler in said hydraulic control system for filtering and cooling said hydraulic fluid, respectively; and a fourth check valve in said header hydraulic conduit to protect said hydraulic pump.

13. The hydraulic pump unit of claim 8 wherein said base means is further characterized as a stationary tray and a support frame slidably mounted on said tray, and carrying said stationary mast and said lifting hydraulic cylinder means, and whereby said support frame is capable of slidable displacement on said tray to move said stationary mast, said traveling mast, said roller means and said bridle away from the well head and the well.

14. The hydraulic pump unit of claim 13 further comprising anchor means attached to said support frame and clamp means attached to said tray, said anchor means normally engaging said clamp means when said support frame is in retracted configuration on said tray.

15. The hydraulic pump unit of claim 13 further comprising a push-off hydraulic cylinder cooperating with said tray and said support frame for selectively displacing said support frame from retracted configuration on said tray.

16. The hydraulic pump unit of claim 13 further comprising:

(a) a push-off hydraulic cylinder cooperating with said tray and said support frame for selectively displacing said support frame from retracted configuration on said tray; and (b) anchor means attached to said support frame and clamp means attached to said tray, said anchor means normally engaging said clamp means when said support frame is in retracted configuration on said tray.

17. The hydraulic pump unit of claim 15 or claim 16 further comprising a sump, and drain means cooperating with said sump for draining fluids from around said push-off hydraulic cylinder.

18. The hydraulic pump unit of claim 16 further comprising a sump, and drain means cooperating with said sump for draining fluids from around said push-off hydraulic cylinder and a concrete pad containing said sump and supporting said tray.

* * * * *